United States Patent [19]

Grushon

[11] 4,023,722

[45] May 17, 1977

[54] PINNING APPARATUS

[75] Inventor: Harold N. Grushon, Dayton, Ohio

[73] Assignee: Monarch Marking Systems, Inc., Dayton, Ohio

[22] Filed: Dec. 18, 1975

[21] Appl. No.: 641,843

[52] U.S. Cl. ..... 227/25; 227/65; 227/136

[51] Int. Cl.[2] ..... B27F 7/02

[58] Field of Search ..... 227/20, 25, 65, 136; 93/88; 29/432.1; 74/42, 44, 470, 473

[56] References Cited

UNITED STATES PATENTS

| | | | |
|---|---|---|---|
| 2,042,888 | 6/1936 | Flood | 227/65 |
| 2,083,150 | 6/1937 | Flood | 227/25 |
| 2,914,768 | 12/1959 | Flood | 227/25 |
| 3,628,393 | 12/1971 | Houk | 74/470 |

*Primary Examiner*—Granville Y. Custer, Jr.
*Attorney, Agent, or Firm*—Joseph J. Grass

[57] ABSTRACT

The illustrated apparatus includes a plunger and a co-operable anvil between which a tag and merchandise are positioned and through which a fastener specifically a pin is driven to attach the tag to the merchandise. While the pin is being driven through the tag and merchandise, a movable pin guiding and crimping member moves relative to the plunger, the tag and the pin. The pin is driven firstly through the tag, secondly through the merchandise, thirdly through the merchandise again, fourthly through the tag again, and fifthly through the tag again, and thereupon the movable pin guiding and pin crimping member is moved again to crimp the pin. A bottom tag in a stack is separated by feeding it toward the pinning zone in one machine cycle and the separated tag is positioned between the anvil and the plunger during the early part of the next machine cycle. The tag feeding device for separating the bottom tag and the tag feeding device for positioning the separated tag at the pinning zone move relative to each other during the pinning cycle. A cycle of machine operation can only be initiated when manually operable actuators disposed on opposite sides of the anvil and plunger are both actuated.

14 Claims, 50 Drawing Figures

FIG-1
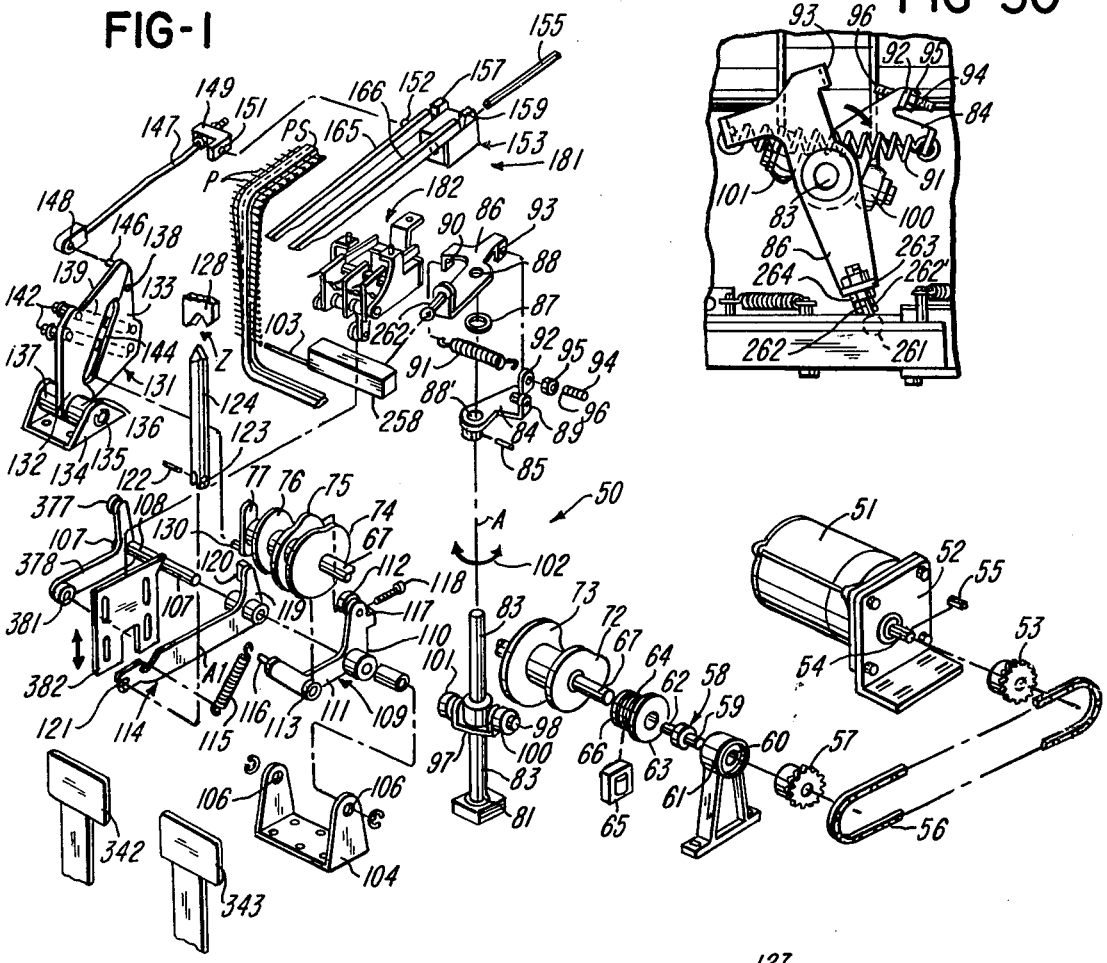
FIG-30
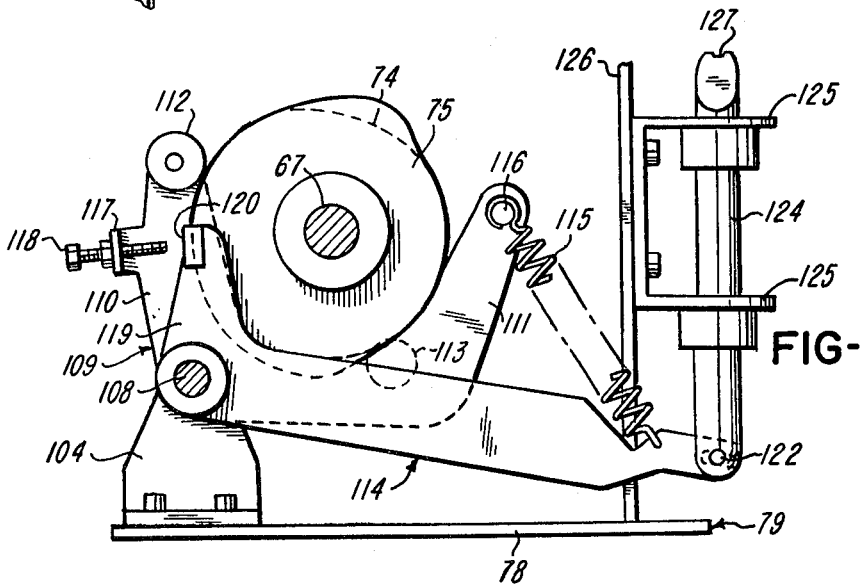
FIG-22

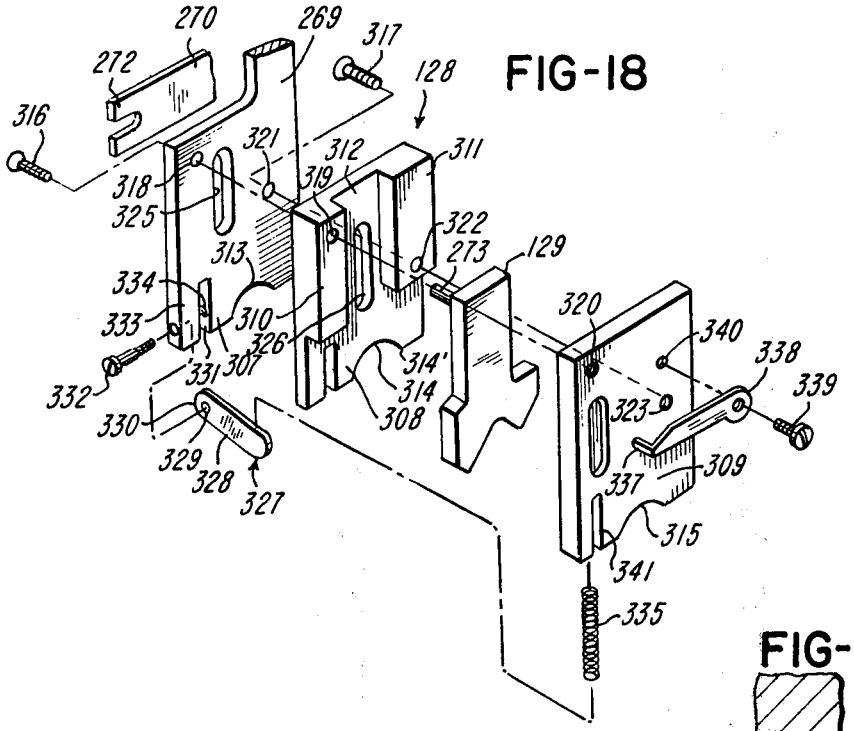
FIG-18
FIG-10A
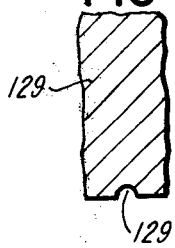
FIG-20
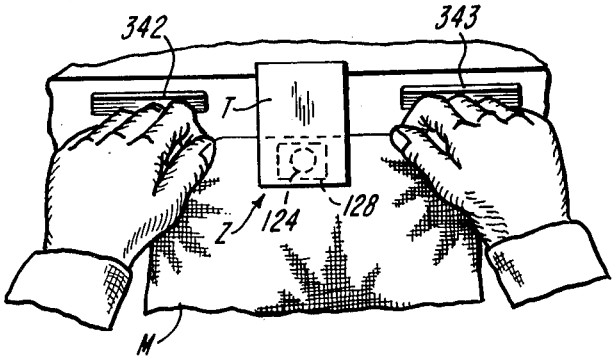
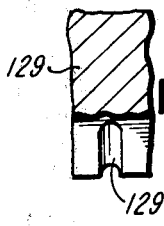
FIG-10B
FIG-9
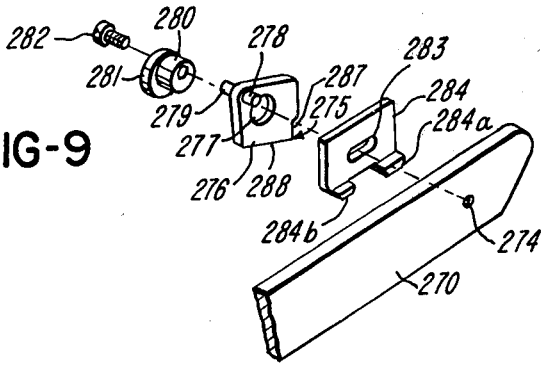

FIG-39
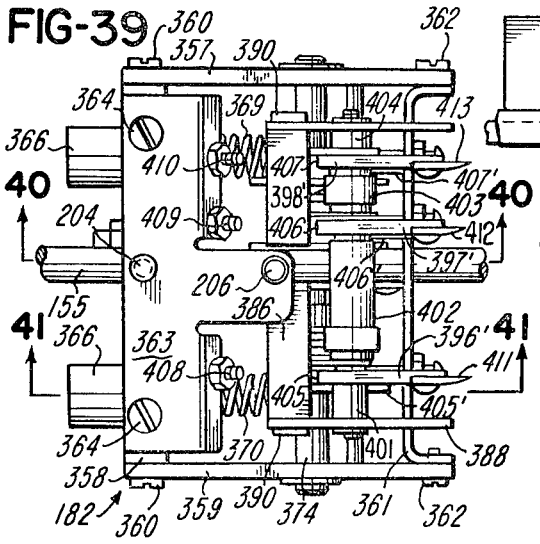
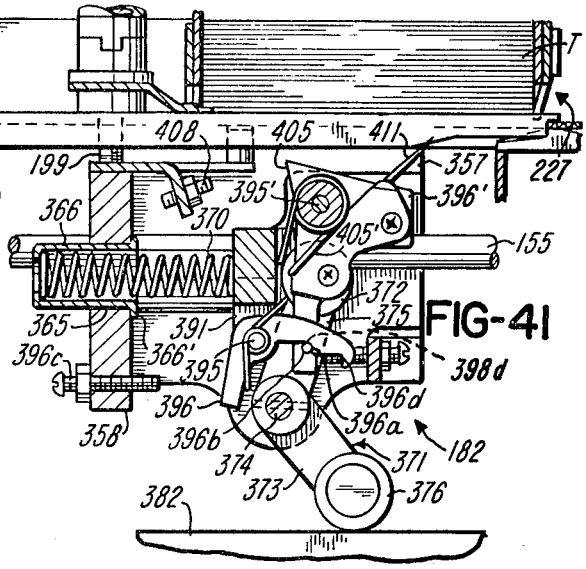
FIG-41
FIG-42
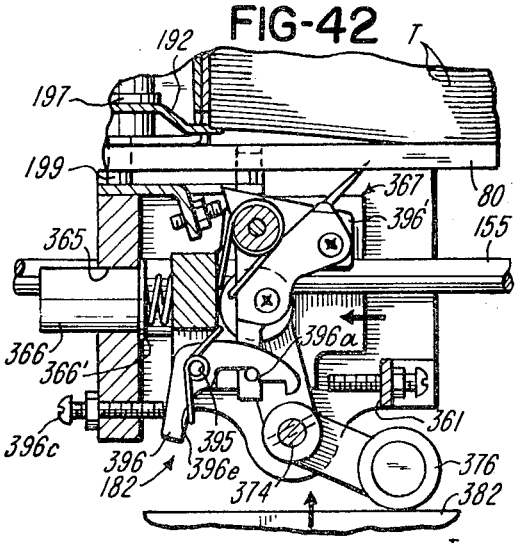
FIG-43
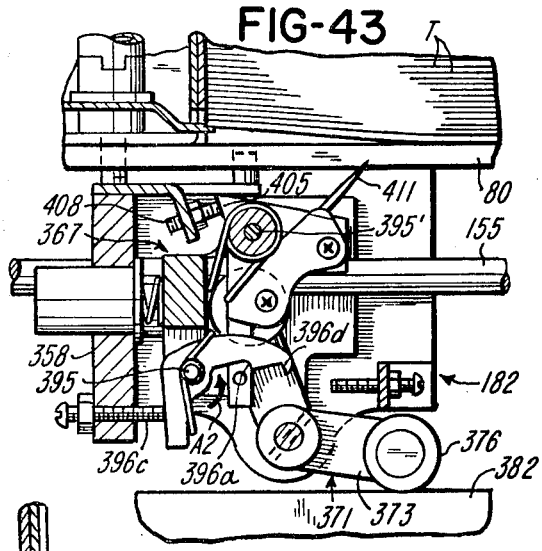
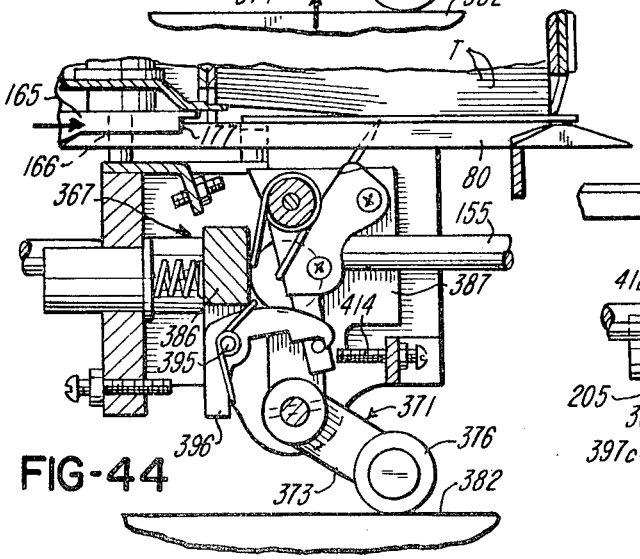
FIG-44
FIG-40
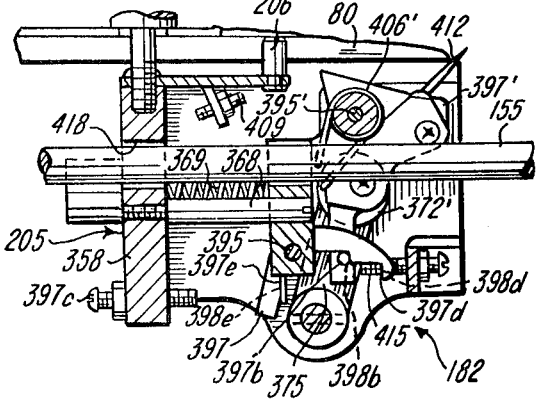

PINNING APPARATUS

SUMMARY OF THE INVENTION

One of the features of the invention relates to the drive mechanism for one of the operative components of a pinning machine, specifically the tag feeding means. It is desired to move the tag feeding device through a considerable distance without the use of large or expensive cams. There is thus provided a drive pin which is movable in a circular path. The drive pin is received in an elongated slot in a follower and it is preferred that the follower be pivotally mounted and that the pin engagement in the slot between the pivot and the place where the tag feeding device is connected to the follower so that the movement of the tag feeding device is relatively large. Another feature of the drive mechanism is in the power transmission from a cam shaft which is disposed generally horizontally to operative components including a pin driver which is disposed above the level of the cam shaft. More particularly, a vertical shaft mounted in vertically spaced-apart bearings is rotated by cam means on the cam shaft to effect transfer of driving force to the pin driver.

BACKGROUND OF THE INVENTION

Field of the Invention

This invention relates to the field of tag attaching apparatus and methods, and particularly pinning machines and methods.

BRIEF DESCRIPTION OF THE DRAWINGS

FIG. 1 is an exploded perspective view showing major components of a pinning machine for carrying out the invention;

FIG. 9 is an exploded perspective view of a fragmentary portion of the mechanism shown in FIG. 5;

FIG. 10A is an enlarged sectional view taken along line 10A—10A of FIG. 10.

FIG. 10B is an enlarged sectional view taken along line 10B—10B of FIG. 10.

FIG. 18 is an exploded perspective view showing mainly the anvil and the pin guiding and crimping member;

FIG. 20 is a fragmentary top plan view showing the manner in which merchandise is manually inserted between the anvil and the plunger and the manner in which the user's hands contact actuators to initiate a cycle of operation;

FIG. 22 is a view similar to FIG. 21 but showing operative follower parts in positions in which the plunger encounters undue resistance;

FIG. 30 is a top plan view showing follower parts in a position in which the pin driver encounters undue resistance;

FIG. 39 is a top plan view of the tag feeding assembly shown in FIG. 38;

FIG. 40 is a sectional view taken generally along line 40—40 of FIG. 39;

FIG. 41 is a sectional view taken generally along line 41—41 of FIG. 39;

FIG. 42 is a view similar to FIG. 41 but showing a slide of the assembly as moving away from the home or initial position shown in FIGS. 38 through 40;

FIG. 43 is a view similar to FIGS. 41 and 42, wherein the latches have been tripped but the needles of the assembly being held out of impaling relationship with respect to the bottom tag in the stack;

FIG. 44 is a view similar to FIGS. 41 through 43, but showing the needle as having moved the bottom tag forward and partially through the gate structure;

DESCRIPTION OF THE PREFERRED EMBODIMENTS

Figures 19, 21, 23, 24:
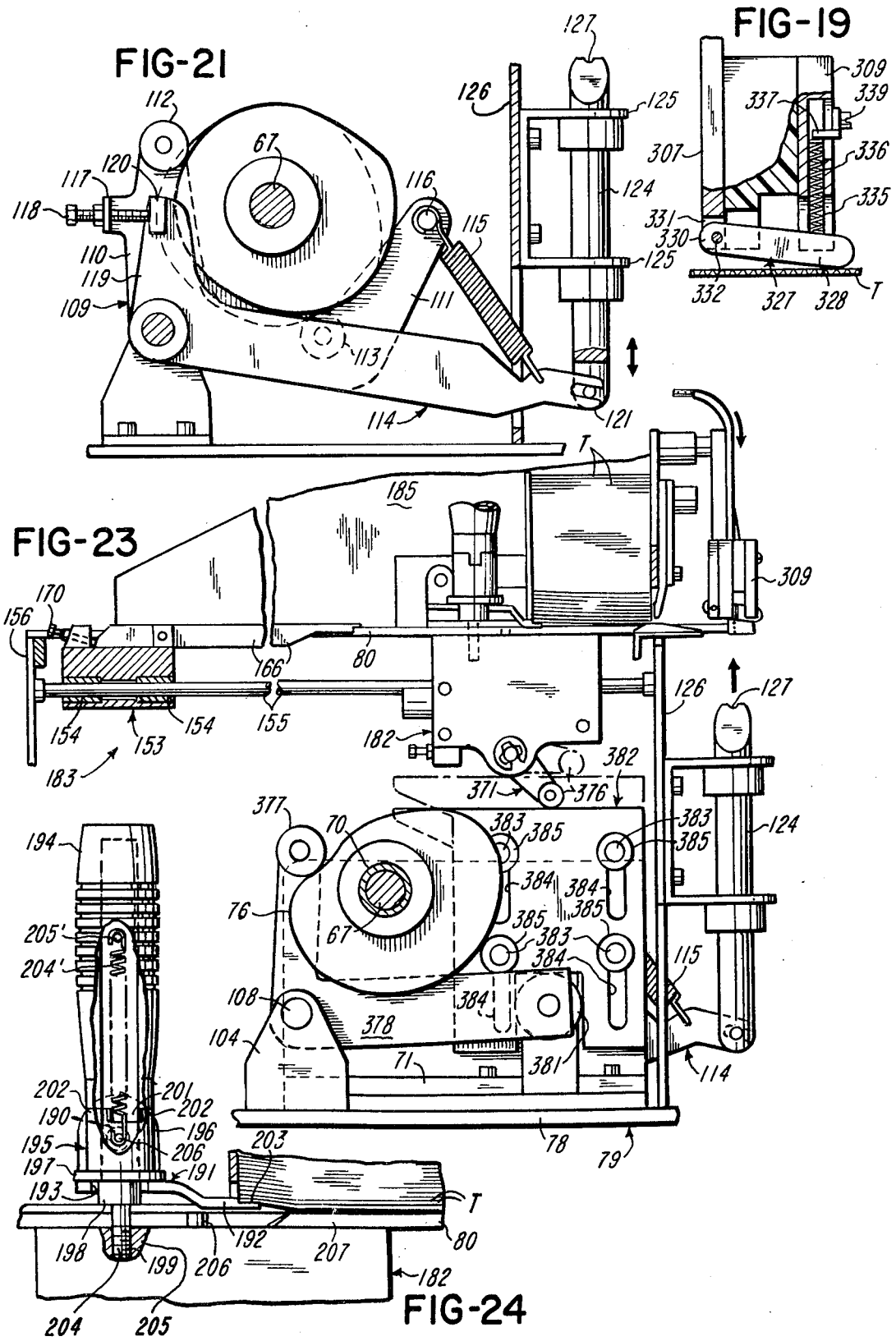
FIG. 19 is an elevational view partly in section showing a brake mounted by the anvil.
FIG. 21 is a sectional view taken along line 21—21 of FIG. 29.
FIG. 23 is a sectional view taken along line 23—23 of FIG. 29.
FIG. 24 is a side elevational fragmentary view showing the manner in which the trailing marginal ends of the tags in the hopper are supported and showing a yieldable handle member.
Figure 25:
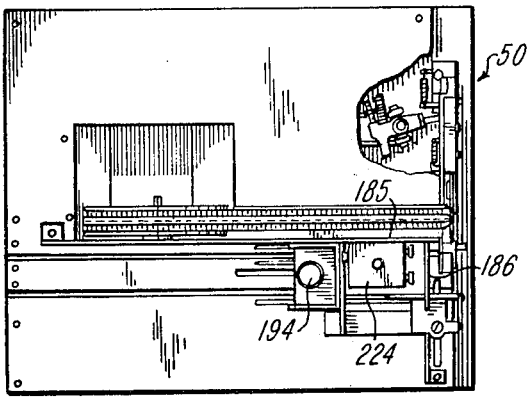
FIG. 25 is a top plan view of the pinning machine.
Figure 29:
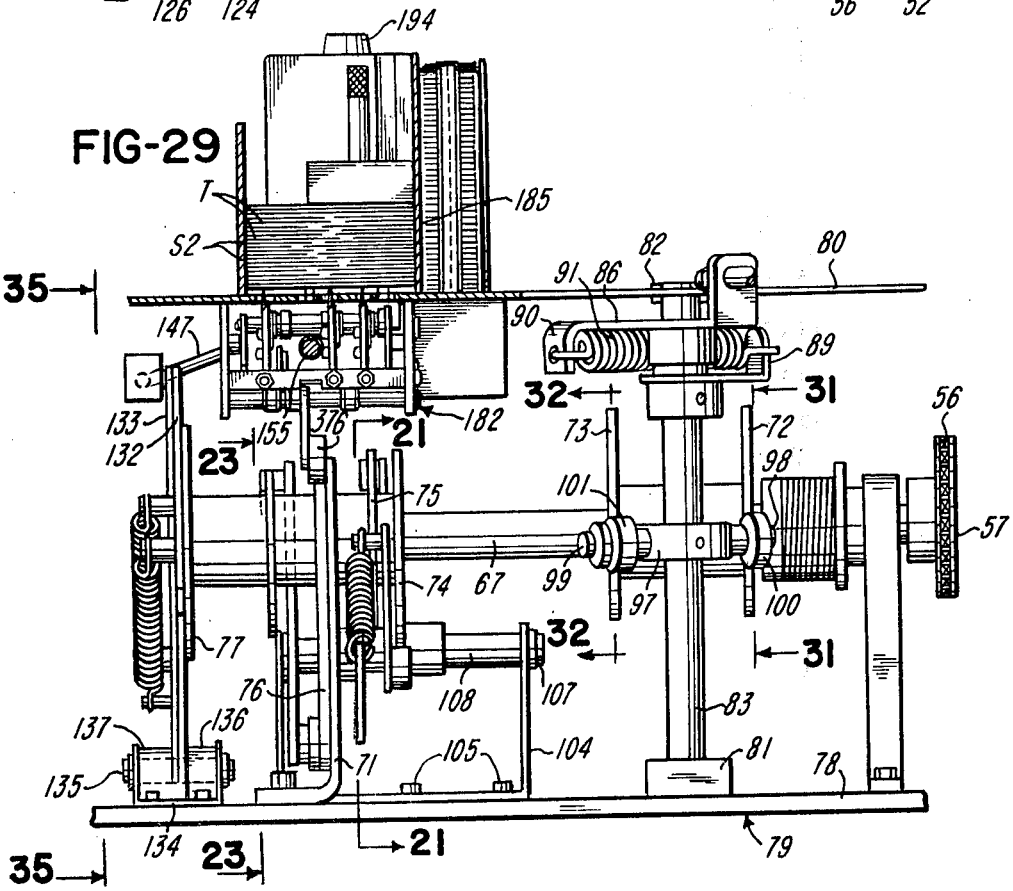
FIG. 29 is an enlarged fragmentary front elevational view showing a portion of the drive train for the pinning machine and the relationship of the feeding mechanism with respect thereto.
Figure 31:
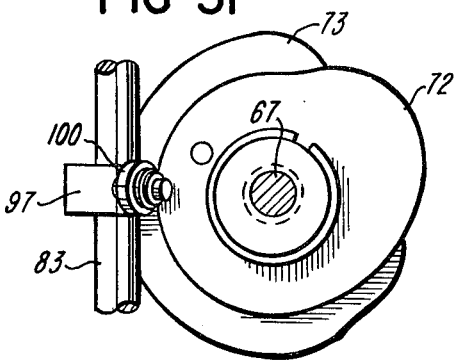
FIG. 31 is an enlarged sectional view taken generally along the line 31—31 of FIG. 29.
Figure 32:
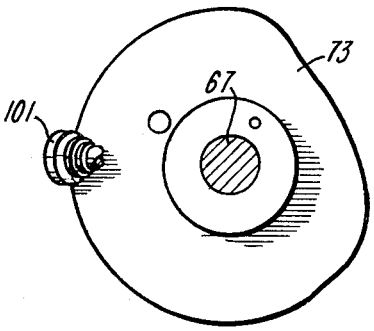
FIG. 32 is an enlarged sectional view taken generally along line 32—32 of FIG. 29.
Figure 33:
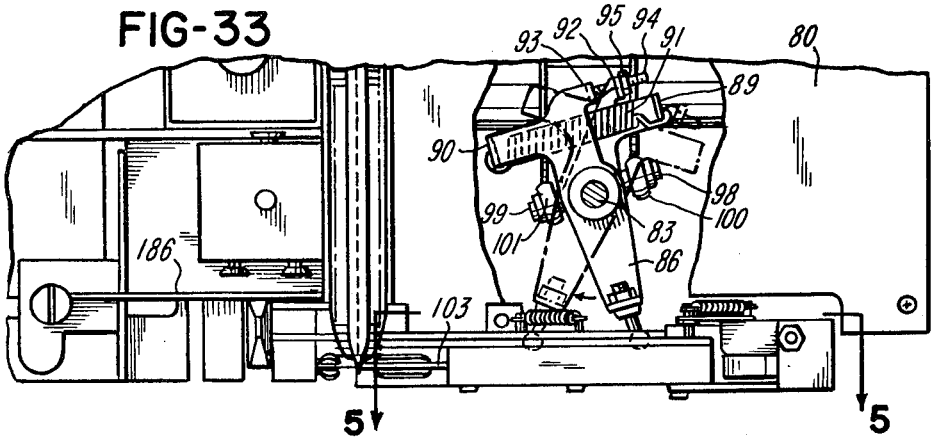
FIG. 33 is an enlarged top plan view of the frontal portion of the pinning machine showing the relationship of certain operative components.

With reference initially to FIG. 1 in which there is shown a fragmentary portion of a pinning machine generally indicated at 50, there is shown an electric motor 51 which drives a speed reducer 52. A sprocket 53 is keyed to output shaft 54 of the speed reducer 52 by a key 55. A roller chain 56 is drivingly engaged with the sprocket 53 and a sprocket 57. A connector generally indicated at 58 has a shaft portion 59 which extends through a core 60 in a bearing 61. The shaft portion 59 is suitably secured to sprocket 57. The connector 58 also has a shaft portion 62 which is suitably secured to the input side 63 of a single revolution wrapped-spring clutch 64. The clutch 64 is engaged by the action of an electromagnet or solenoid 65. Output side 66 of the clutch 64 is secured to cam shaft 67. The cam shaft 67 is thus rotatably supported by the bearing 61 and in a bearing 70 mounted in a bracket 71 (FIGS. 23 and 29). Cams 72 through 76 and a crank 77 are secured to and rotate as a unit with the cam shaft 67.

The speed reducer 52, the bearing 61, and the bracket 71 are secured to a generally horizontal base plate 78 (FIG. 29) of a frame generally indicated at 79. The frame 79 also includes a generally horizontal frame plate 80 (FIG. 29) disposed above the base plate 78. The base plate 78 mounts a bearing 81 and the frame plate 80 mounts a bearing 82 disposed vertically above the bearing 81. Referring again to FIG. 1, there is shown a generally vertical shaft 83, which is rotatable in the bearings 81 and 82. An arm 84 is secured to the shaft 83 by a set screw 85. An actuator 86 is spaced from the arm 84 by a washer 87. The shaft 83 extends through a hole 88 in the actuator 86 and through a hole 88′ in the arm 84. The arm 84 and the actuator 86 have respective flanges 89 and 90 which anchor the ends of a tension spring 91. The arm 84 and the actuator 96 also have respective flanges 92 and 93. A screw 94 is threadably received by the flange 92 and is held in its adjusted position by a lock nut 95. Free end 96 of the screw 94 is normally in contact with the flange 93 due to the action of the tension spring 91, and in this position the arm 84 and the actuator 86 rotate as a unit together with the shaft 83.

The shaft 83 carries a bracket 97. The bracket 97 includes aligned posts 98 and 99 (FIG. 29) for rotatably mounting respective roller followers 100 and 101. The followers 100 and 101 are driven by respective cams 72 and 73 to rock the shaft 83 in opposite directions about the generally vertical axis A as indicated by double-headed arrow 102 in FIG. 1. One complete revolution of the cam shaft 67 will cause the actuator 86 to be driven in the clockwise direction as viewed in FIG. 1 to move a pin driver 103 generally to the left and will thereafter cause the actuator 86 to be driven in the counterclockwise direction to move the pin driver 103 generally to the right.

A bracket 104 is secured to the base plate 78 by fasteners 105 (FIG. 29). The bracket 104 has aligned holes 106 which rotatably mount end portions 107 of a shaft 108. A lever or bell crank generally indicated at 109 has arms 110 and 111. The arm 110 rotatably mounts a roller follower 112 and the arm 111 rotatably mounts a roller follower 113. The followers 112 and 113 cooperate with respective cams 75 and 74. A lever or bell crank 114 is movably mounted on and with respect to the shaft 108. A tension spring 115 is anchored at one end to a pin 116 carried by the arm 111 and is anchored at its other end to the lever 114, as better shown in FIG. 21. The arm 110 has a flange 117 which threadably receives a set screw 118. The bell crank 114 has an arm 119 having a flange 120. The screw 118 normally abuts the flange 120 as shown in FIG. 21 due to the force exerted by the spring 115, and accordingly, the bell cranks 109 and 114 rotate together as a unit. The lever 114 has a bifurcated end 121 which receives a pin 122 which extends through bifurcated end 123 of a plunger 124. The plunger 124 is suitably guided for generally vertical movement along a vertical axis in a guide 125 (FIG. 21). The guide 125 is secured to a frame member or plate 126 which also constitutes part of the frame 79. The upper end of the plunger 124 has a pin guide groove 127. The plunger 124 is cooperable with an anvil generally indicated at 128. The anvil 128 is shown diagrammatically in FIG. 1 and in detail in FIG. 18. Movably mounted to the anvil is a movable member 129 (FIG. 18) which serves the dual function of guiding and crimping the pin.

As seen in FIG. 1, the crank 77 includes a pin 130. Rotation of the cam shaft 67 causes the pin 130 to be driven in a circular path. The pin 130 drives a follower generally indicated at 131. The follower 131 includes a pair of follower members or sections 132 and 133. A bracket 134 is suitably secured to the base plate 78. The bracket 134 mounts a shaft 135. The follower sections 132 and 133 are generally flat plates. The follower section 132 is secured to a bushing 136 rotatably mounted on the shaft 135 and the follower section 133 is secured to a bushing 137 rotatably mounted on the shaft 135.

Figures 2, 3, 4, 45:
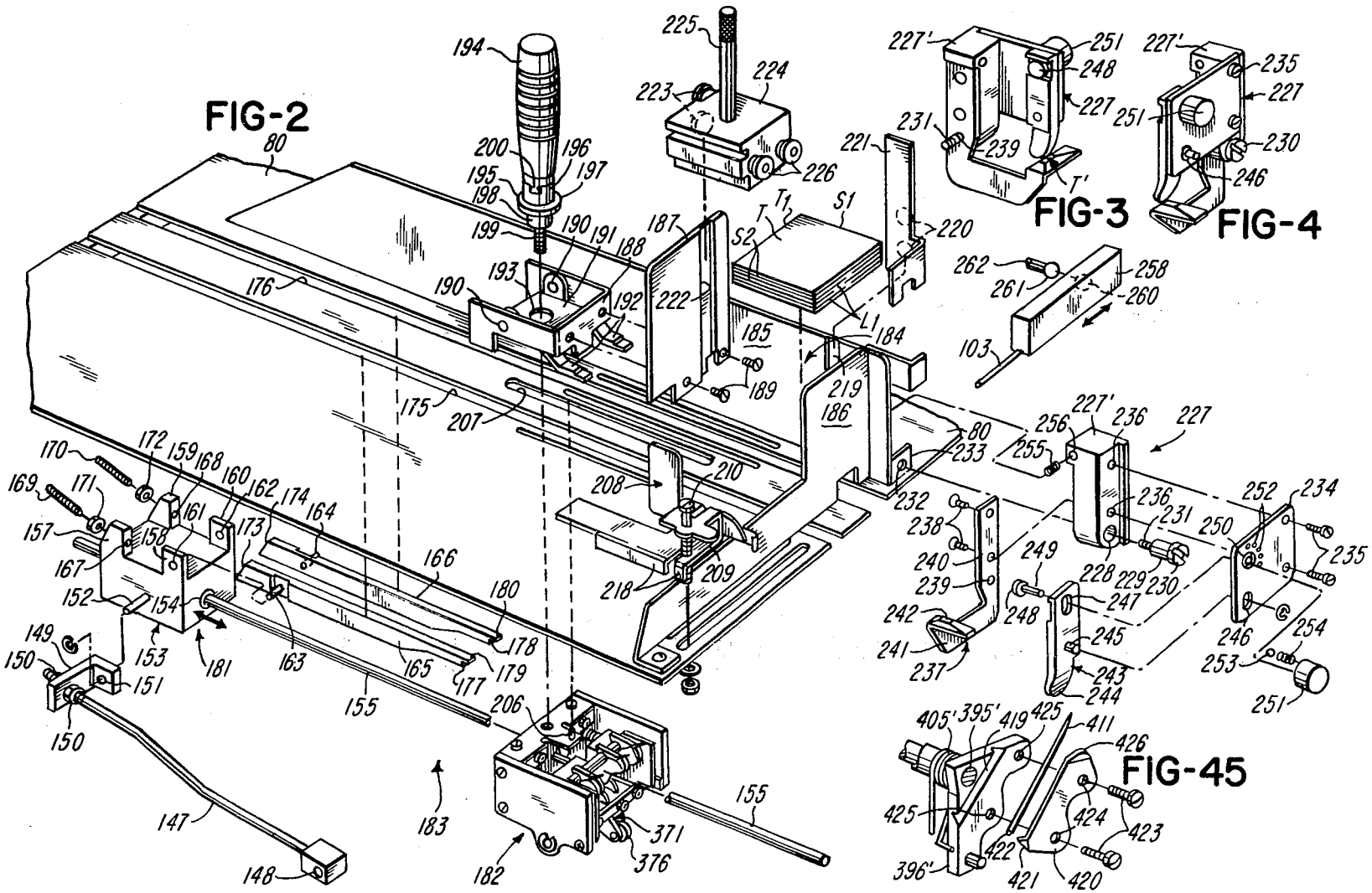
FIG. 2 is an exploded perspective view on a larger scale than FIG. 1, showing major components of the tag feeding mechanism.
FIG. 3 is a perspective view of the gate structure shown in exploded form in FIG. 2.
FIG. 4 is a perspective view of the gate structure from a different viewing angle.
FIG. 45 is a fragmentary perspective exploded view showing the manner in which the needles are removably mounted to the assembly.
Figure 35:
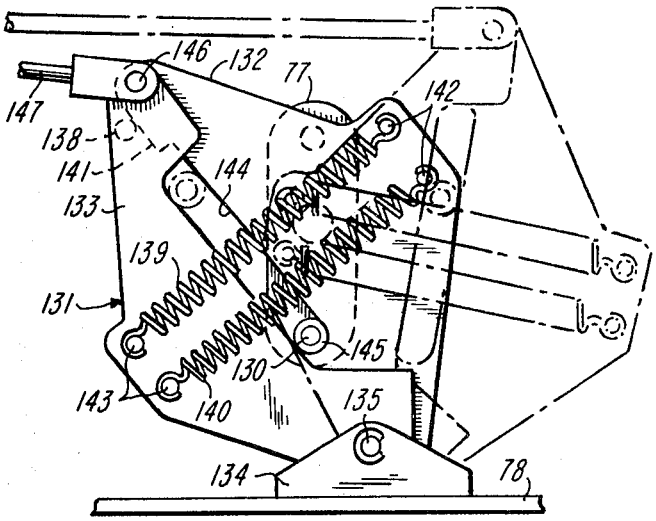
FIG. 35 is a view taken along line 35—35 of FIG. 29 showing operative follower parts in both solid and phantom line positions.
Figure 36:
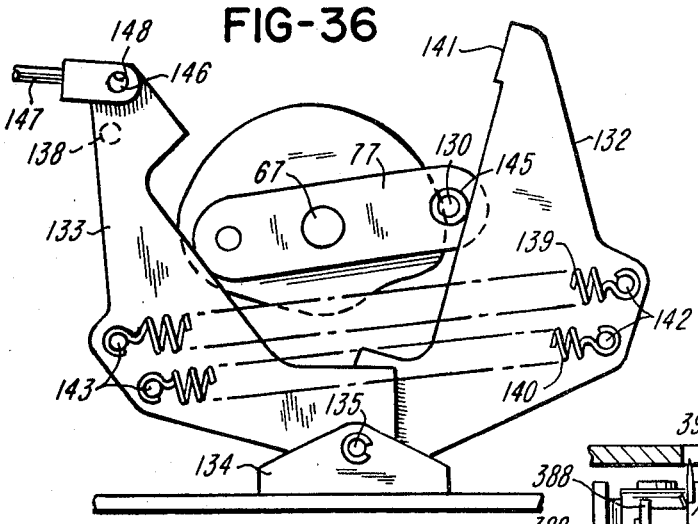
FIG. 36 is a view similar to FIG. 35 showing the follower parts moved relatively apart due to undue resistance encountered by the tag feeding mechanism.
Figure 38:
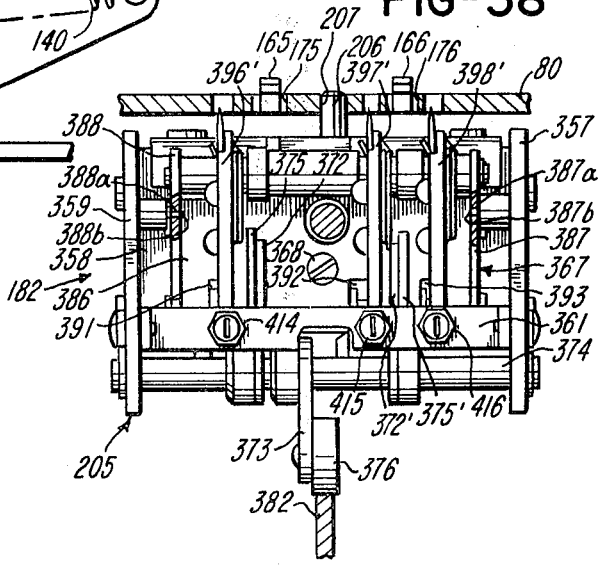
FIG. 38 is a front elevational view of a tag feeding assembly of the tag feeding mechanism.

The follower section 132 bears against a post 138 in the position shown in FIG. 1. Springs 139 and 140 urge a face 141 (FIG. 36) of follower section 132 against the post 138. As shown in FIGS. 35 and 36 springs 139 and 140 are connected at their respective ends to posts 142 and 143 on the respective follower sections 132 and 133. In the position of the follower 131 shown in FIGS. 1 and 35, the follower sections 132 and 133 provide an elongated slot 144 in which the pin 130, which includes a roller 145, is received. In that the pin 130 is eccentric with respect to the cam shaft 67 and because slot 144 is positioned between the shaft 135 and a pivot 146 secured to the follower section 133, the pivot 146 travels through a considerable distance. This movement through a considerable distance is accomplished using the follower 131 which is relatively inexpensive to manufacture. With reference to FIG. 1, a rod 147 has a hole 148 in which the pivot 146 is received. The other end of the rod 147 passes freely through a hole in a connector 149. Nuts 150 (FIG. 2) threadably received by the rod 147 securely connect the connector 149 to the rod 147 at a selected position. With reference to FIG. 2, the connector 149 has a hole 151 in which a post or pivot 152 is received. The pivot 152 is secured to a block or slide 153. The slide 153 has bearings 154 (FIG. 23). A rod or guide 155, which is shown to be annular, extends through and slidably mounts the bearings 154. The rod 155 is secured at one end to the frame plate 126 and at its other end to a frame plate 156 which constitutes part of the frame 79. The rod 155 extends generally horizontally and is disposed below the frame plate 80 which is connected to the frame plates 126 and 156. The slide 153 has four upstanding posts 157, 158, 159 and 160 (FIG. 2) and respective aligned holes 161 and 162 for receiving respective pivot pins 163 and 164 carried by respective feed fingers 165 and 166. The posts 157 and 159 have respective threaded bores 167 and 168 which recieve respective set screws 169 and 170 which can be locked into position by means of nuts 171 and 172. The set screws 169 and 170 bear against inclined shoulders 173 and 174 of the respective feed fingers 165 and 166. The set screws 169 and 170 enable individual annular adjustment of the respective feed fingers 165 and 166 with respect to the horizontal. The feed fingers 165 and 166 are free to move in respective slots 175 and 176 in the frame plate 80. The feed fingers 165 and 166 have respective drive faces 177 and 178 which are disposed below respective overhanging abutments or faces 179 and 180. It is apparent that the initial and final positions of travel of the feed fingers 165 and 166 can be adjusted by loosening the nuts 150 and moving the connector 149 to a different position with respect to the rod 147 and when the connector 149 is in the selected adjusted position the nuts 150 can be retightened.

With reference to FIG. 2, the feed fingers 165 and 166 and the slide 153 constitute one feed assembly or device generally indicated at 181. The tag feeding or tag separating device 181 and a tag feeding or tag positioning assembly or device generally indicated 182 constitute a tag feeding mechanism 183 of the apparatus 50. The tag feeding device 182 is used to separate the bottom tag T in a stack S held in a hopper generally indicated at 184. The tag feeding device 182 separates the bottom tag T from the stack S by feeding the bottom tag a predetermined distance toward a tag attaching or specifically a pinning zone Z (FIG. 1) between the plunger 124 and the anvil 128, and the feed fingers 165 and 166 engage a separated tag T and feed the separated tag T to the proper position in the pinning zone Z. The tag feeding device 182 will be described in greater detail in connection with FIGS. 24 and 38 through 44.

Figure 26:
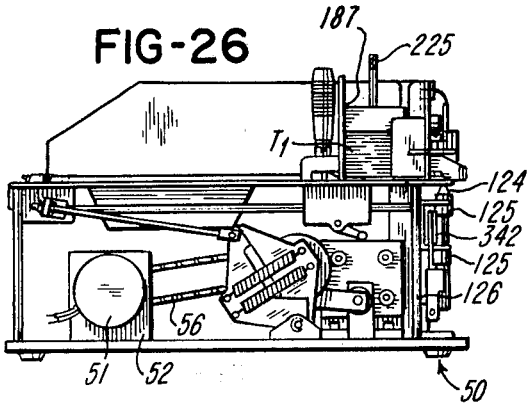
FIG. 26 is a left side elevational view of the pinning machine.
Figure 27:
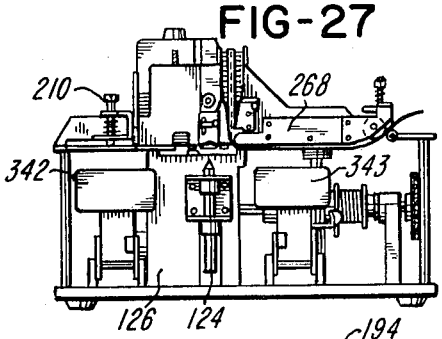
FIG. 27 is a front elevational view of the pinning machine.
Figure 28:
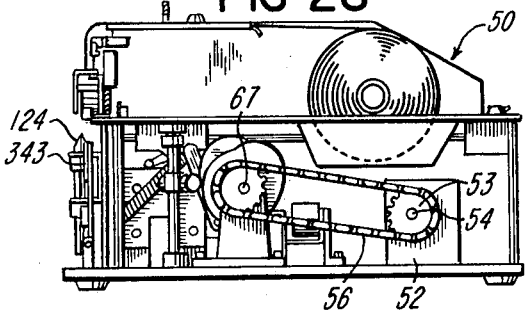
FIG. 28 is a right side elevational view of the pinning machine.
Figure 34:
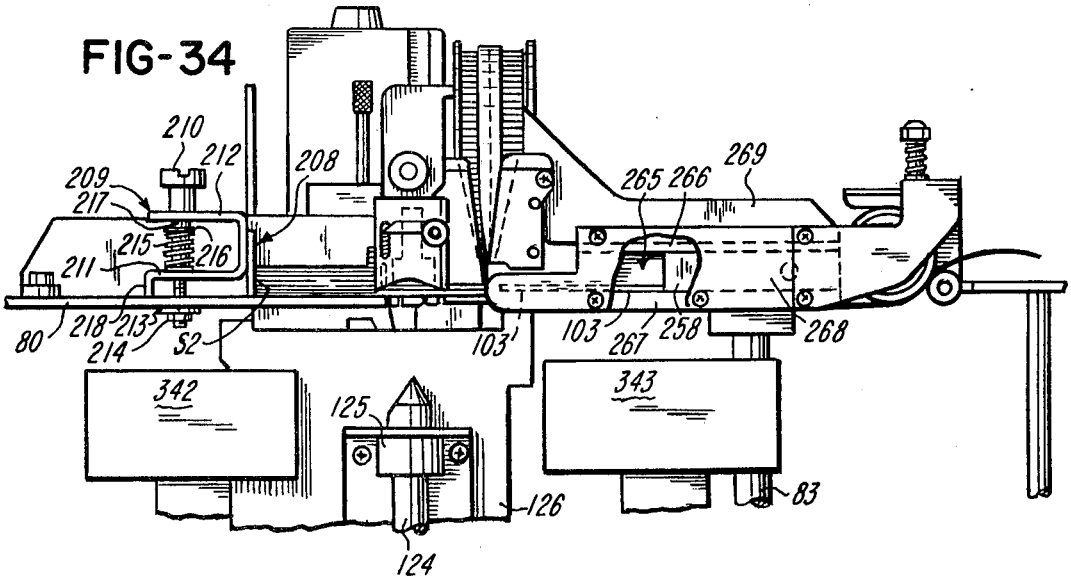
FIG. 34 is an enlarged front elevational view showing the frontal portion of the machine.

The hopper 184 is constructed to accept tags of various lengths and widths. The hopper 184 includes a generally vertical side plate 185 which is secured to the generally horizontal frame plate 80. A generally vertical front plate 186 is secured to the frame plate 80 and to the side plate 185. The plates 185 and 186 provide reference planes for side edges S1 and leading edges L1 of the tags T, respectively. A plate or guide 187 is positioned against trailing edges T1 of the tags T, as best shown in FIG. 26. The guide 187 is secured to a bracket generally indicated at 188 by scrws 189 as shown in FIG. 2. The bracket has aligned pivots 190 which pivotally mount a support 191 having support fingers or members 192. The support 191 has a hole 193. A handle 194 is coupled to a connector generally indicated at 195 secured to the tag feeding device 182. With reference to FIGS. 2 and 24, the connector 195 is shown to have a body 196, an annular flange 197, a shoulder 198, and a screw 199 projecting from the shoulder. The connector 195 is shown to be of one-piece construction. The handle 194 and the connector 195 are coupled by a jaw clutch generally indicated at 200. The jaw clutch 200 is comprised in part by three equally annularly spaced teeth 201 and in remainder by three equally annularly spaced teeth 202 on the connector 195. The jaw clutch 200 enables the handle 194 to be rotated in opposite directions to tighten or loosen screw 199. Rotation of the handle 194 so as to tighten screw 199 causes the support 191 to pivot counterclockwise (FIG. 24) due to the action of the flange 197 bearing on the support 191. When the handle 194 is rotated so as to loosen the screw 199 the support 191 will pivot clockwise (FIG. 24) due to gravity. In the position shown in FIG. 24, the trailing marginal ends of the tags T are raised above the plate 80 on which the tags T are supported. The trailing marginal ends of the tags T rest on ledges 203 of the respective support fingers 192 and are thus spaced from the plate 80 that supports the remainder of the tags T. In order to prevent the user from breaking the handle 194 by pushing or pulling on it, there are gaps between the teeth 201 of the handle and the teeth 202 of the connector 195. A tension spring 204′ is connected at one end to a post 205′ mounted inside the handle 194 and to a post 206′ mounted inside the connector 195. Construction of the jaw clutch 200 will enable the handle to be deflected with respect to the connector 195 and the spring 204 will return the handle 194 to the upright position shown in FIGS. 2 and 24. The screw 199 is received in a threaded bore 204 in frame or body 205 of the device 182. Upon tightening of the screw 199, the flange 197 bears against the support 191 and the body 205 is drawn up against the underside of the plate 80 to prevent movement of the support 191, the associated bracket 188, the plate 187, and the tag feeding device 182. The screw 199 and a pin 206 secured to the body 205 extend through elongated slot 207 in the plate 80. The pin 206 and upper shank of the screw 199 fit in the slot 207 with a minimum of clearance so that the tag feeding device 182, the bracket 188, the support 191, and the guide 187 can be slid for guided movement toward and away from the pinning zone Z upon loosening the screw 199. Thereafter, upon tightening the screw 199 by rotating the handle 194, the device 182, the bracket 188, the support 191, and the plate 187 can be clamped in position. The hopper 184 also includes a side guide generally indicated at 208. With reference to FIGS. 2 and 34, side guide 208 is shown to be movable into guided contact with side edges S2 of the tags T. The lower edge of the side guide 208 contacts the upper surface of the plate 80. A generally U-shaped bracket 209 is welded to the side guide 208. Screw 210 extends through arms 211 and 212 of the bracket 209. A washer 213 bears against the underside of the plate 80 and a nut 214 threadably received by the screw 210 bears against the underside of the washer 213. A spring 215 bears against the arm 211 and against the C-ring 216 secured to shank 217 of the screw 210. The arm 211 has a depending flange 218 which bears against the upper surface of the plate 80. The forces exerted on the plate 80 by the guide 208 and the flange 218 and the opposite force exerted on the plate 80 by the washer 213 frictionally hold the side guide 208 in any desired lateral position. The frictional forces can be changed by loosening or tightening the nut 214 relative to the screw 210. The side guide 208 can be shifted laterally manually.

The side guide 185 (FIG. 2) has a vertically extending undercut groove 219 for receiving mating pins 220 of a weight 221. The weight 221 exerts a downward force at the leading marginal edge of the top tag T of the stack S. The guide 187 has an undercut groove 222 for receiving mating rollers 223 mounted to a weight 224. By unthreading a handle 225 from the weight 224, the weight 224 can be oriented so that the rollers 223 fit into the groove 222 for tags of narrower width. A gate mechanism generally indicated at 227 includes a body 227' having a bore 228 for receiving annular shank 229 of a pivot screw 230, a threaded portion 231 of which is received in a threaded bore 232 in a mounting member 233 connected to the plate 80. A plate 234 is secured to the body 227' by screws 235 received in threaded bores 236. A gate member generally indicated at 237 is secured to the body 227' by screws 238 also received in the threaded bores 236. The threaded portion 231 extends freely through an oversized hole 239 in the gate member 237. The gate member 237 has an upstanding portion 240 joined to a generally horizontal laterally extending portion 241. A gate element generally indicated at 242 is connected to the portion 241.

Another gate member generally indicated at 243 has a gate element 244 which is spaced from the gate element 242 to provide a gate opening or throat T'. The gate element 243 has a pin 245 received in an elongated slot 246 in the plate 234. An eccentric 248 received in the hole 247 is secured to a shaft 249 which extends through a hole 250 in the plate 234. The shaft 249 is secured to a knob 251. The plate 234 has a plurality of depressions 252. A ball 253 acted on by a spring 254 disposed in the knob 251 can cooperate with the depressions 252 to hold the knob 251, the shaft 249 and the eccentric 248 in a selected position. Rotation of the knob 251 will rotate the eccentric 248 and raise or lower the gate member 243 in accordance with the direction in which the knob 251 is rotated, thereby changing the gate opening or throat T'. In the assembled condition of the gate mechanism 227 illustrated in FIGS. 3 and 4, the body 227', the plate 234, the gate members 237 and 243 and the associated hardware rotate as a unit about the shank 229 of the pivot screw 230. The gate mechanism 227 is urged clockwise as viewed in FIG. 2 by a compression spring 255, a porton of which is received in a depression 256 in the body 227. The spring 255 bears against the surface of the side guide 185. The spring 255 causes the gate element 242 to contact the leading marginal edge of the bottom tag T in the stack S.

Figures 5, 6, 7, 8, 10, 11, 12, 13, 14, 15, 16, 17:
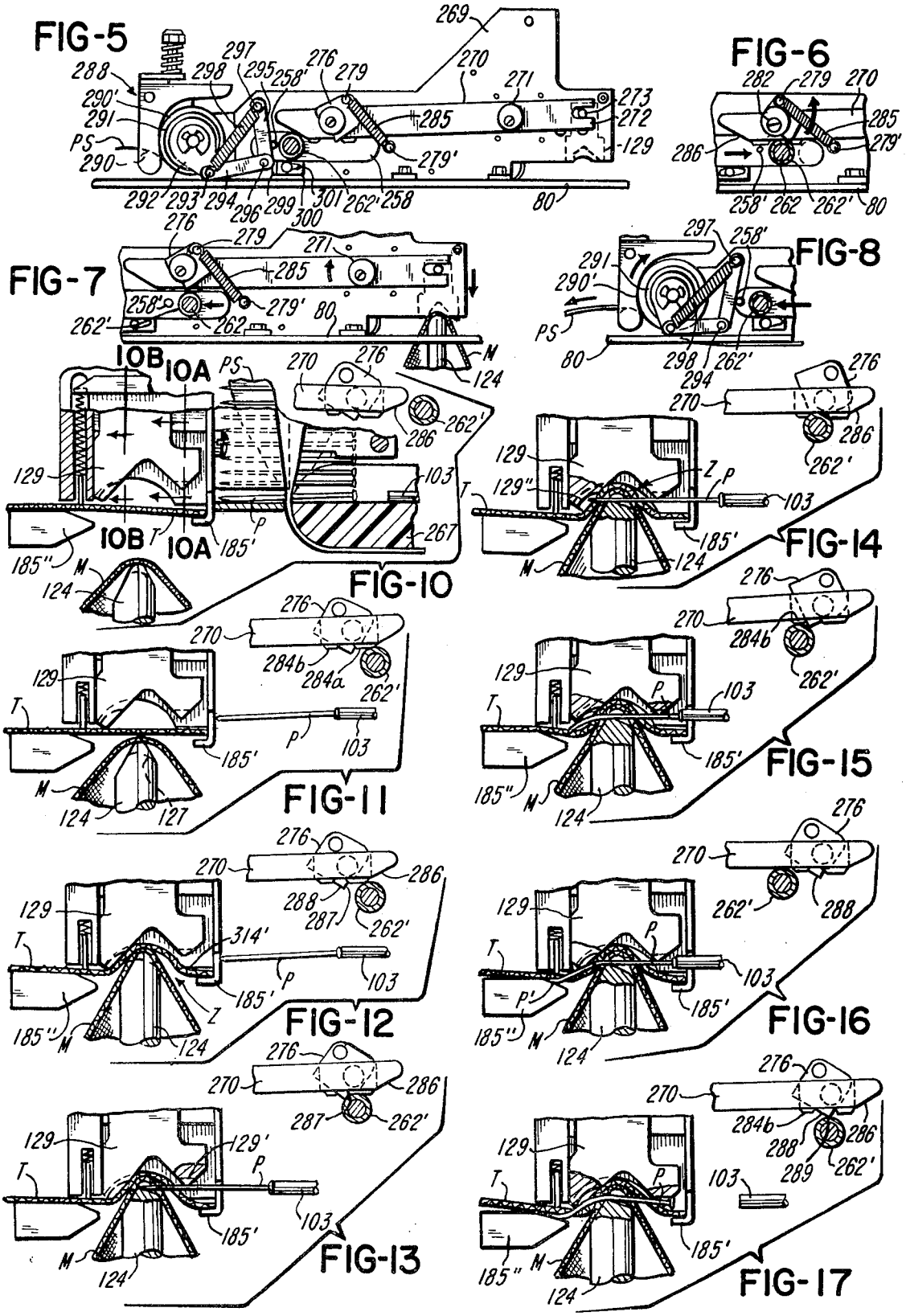
FIG. 5 is an elevational view taken generally along line 5—5 of FIG. 33.
FIG. 6 is a view showing a fragmentary portion of the mechanism shown in FIG. 5, but in a different position.
FIG. 7 is a view showing a fragmentary portion of the mechanism shown in FIG. 5, in yet a different position.
FIG. 8 is a view showing a fragmentary portion of the mechanism shown in FIG. 5 in still a different position.
FIG. 10 is a fragmentary front elevational view showing a plunger, an anvil, and a pin driver in their initial or home positions, with merchandise positioned between the plunger and the anvil, and with a tag moving toward its final position at the pinning zone between the anvil and the plunger.
FIG. 11 is a view similar to FIG. 10, but showing the pin guiding and crimping member as having moved downwardly into contact with the tag, the plunger as moving upwardly toward the anvil, and the pin driver as starting to drive a pin.
FIG. 12 is a view similar to FIG. 11, but showing the plunger cooperating with the anvil.
FIG. 13 is a view similar to FIG. 12, but showing the pin as having been driven through both the tag and the merchandise once.
FIG. 14 is a view showing the pin as having been driven through both the tag and the merchandise twice and showing the pin guiding and crimping member as having moved upwardly.
FIG. 15 is a view showing the pin penetrating the tag for the third time and showing the pin guiding and crimping member as having moved downwardly again.
FIG. 16 is a view showing the pin as having been driven through the tag for the third time and showing the pin guiding and crimping member as having moved upwardly again.
FIG. 17 is a view showing the pin guiding and crimping member as moving toward the plunger to crimp the pin, the leading end portion of which is supported by a guide or support.

FIGS. 1 and 2 show the pin driver 103 carried by a slide 258. The slide 258 has a socket 260 for receiving a ball-shaped end portion 261 of an extension 262 threadably secured to a flange 263 of the arm 86 and held in adjusted position by lock nuts 264. The slide 258 and the pin driver 103 are received in a guideway generally indicated at 265 (FIG. 34) provided by upper and lower plates 266 and 267 and front and rear plates 268 and 269. The plate 266, 267, 268 and 269 are considered to be part of the frame 79. When the arm 86 pivots clockwise as viewed in FIG. 1, the pin driver 103 is driven to the left and when the arm 86 pivots counterclockwise, the pin driver 103 is driven to the right. With reference to FIG. 5, the rear plate 269 mounts a lever 270 for pivotal movement about an adjustable eccentric pivot 271. The one end of the lever 270 on one side of the pivot 271 is bifurcated as indicated at 272 and receives a pin 273 carried by the movable member 129. With reference also to FIG. 9, the lever 270 has a threaded bore 274, a one-way drive connection 275 including a plate 276 having a hole 277 and a pair of posts 278 and 279. An eccentric 280 received in the hole 277 pivotally mounts the plate 276. A screw 282 extends through the collar 281, the eccentric 280, and an elongated slot 283 in a cam plate 284 and is received in the threaded bore 274. A tension spring 285 is connected at one end to the post 279 and at its other end to a post 279' connected to the plate 269. The tension spring 285 normally urges the plate 276 clockwise as viewed in FIG. 5 to a position in which the post 278 rests against the cam plate 284. The cam plate 284 has cam lobes **284*a* and 284*b*. The cam lobe 284*a* is considered to be an extension of a cam face or surface 286 on the lever 270. The cam face 286 is adapted to be contacted by a roller 262' on the actuator 86 to pivot the lever 270 counterclockwise as the roller 262 moves to the left as viewed in FIG. 10. Counterclockwise pivoting of the lever 270 will drive the movable member 129 toward the plunger 124 and the tag T. The member 129 will thus be driven from the position shown in FIG. 10 to the position shown in FIG. 11. In the position shown in FIG. 11, the lever 270 has pivoted counterclockwise and bears against the lobe 284*a*. In the position shown in FIG. 11, the member 129 preferably just touches a tag T at the pinning zone Z without bending that tag T. As the cam shaft 67 continues to rotate, the plunger 124 continues to move upwardly to theposition shown in FIG. 12. It should be noticed that because of dwell in cams 72 and 73, the roll 262' is in the same position in FIGS. 11 and 12 and the same is true for the pin driver in 103. However, in FIG. 12 the plunger 124 has moved upwardly to its fullest extent and has bent the tag T which is supported by a guide 185', by edge 314' of an anvil member 311 (FIG. 18), by concave surface 315 of an anvil member 309, by movable member 129 and by a guide or support 185''. As the roller 262' continues to move toward the left to the position shown in FIG. 13 it encounters a drive face 287 on the plate 276, thereby causing the plate 276 to be rotated clockwise against the light force exerted by the spring 285. In the position of FIG. 13, pin P has passed through the tag T and the merchandise M once and is in guided relationship by a guide groove 129' in member 129. The pin P is inclined downwardly slightly with respect to the horizontal as shown but remains straight. When the cam-shaft 67 has rotated so that the roll 262' is in the position shown in FIG. 14, the lever 270 has rotated clockwise under the urging of the spring 285, thus raising the member 129 ro, stated another way, moving the member away from the tag T, the pin P, and the plunger 124. The pin driver 103 has driven the pin P to a position in which its leading end is contacting groove 129''. While the roll 262' moves from the position shown in FIG. 14 to the position shown in FIG. 15, the lever 270 rotates counterclockwise thus driving the member 129 toward the plunger 124, the tag T and the pin P. This movement of the member 129 causes the pin P to be guided or bent toward the tag T as best shown in FIG. 15. As the roll 262' continues to move to the left the roll 262' moves off the lobe 284*b* and the lever 270 is thus urged clockwise by the spring 285, thus raising the member 129 away from the pin P, the tag T and the plunger 124. In the position shown in FIG. 16, the pin P has passed through the tag T for the third time and the leading marginal end P' of the pin P is guided or supported by the pin guide or support 185''. Due to the inclination of the face of the support 185'' and the angle of approach of the pin P, the leading marginal end P' of the pin P is driven upwardly as the pin P continues to be pushed to the left by the pin driver 103. After the roll 262' has moved to the left to the end of its travel, it begins to move to the right. When the roll 262' encounters the cam lobe 284*b* the lever 270 pivots counterclockwise to drive the member 129 downwardly, however, when the roll 262' encounters a cam face 288 on the plate 276 the member 129 is driven further toward the plunger 124, the tag T and the pin P into the position illustrated in FIG. 17 in which the pin P is crimped. During crimping the plunger 124 is momentarily urged downwardly against the action of the spring 115. The member 129 is in its maximum downward position when the lower tip 289 of the cam face 288 is immediately above the high point of the roll 262'. In the position shown in FIG. 17, the member 129 has been driven downwardly to a greater extent than in the embodiments of FIGS. 11, 12, 13 and 15. After the drive member 129 has cleared the cam face 288, the spring 285 pivots the lever 270 clockwise and the roll 262' rides along the lobe 284*a* and cam face 286 until the drive member 262 has returned to the position shown in FIG. 10. As shown the cam surfaces 284*a* and 284*b* lie along a straight line passing through the axis of rotation of the lever 270 so that the member 129 is in the same position in FIGS. 11, 12, 13 and 15, so that the member 129** just touches the tag T without bending it as is preferred.

Referring to FIG. 5, the slide 258 carries a pin 258' which is used to actuate the pin strip actuating mechanism generally indicated at 288. Referring briefly to FIG. 10, the pins P are carried in the paper strip PS. The paper strip PS is folded as shown in FIG. 10 and passes in the folded condition under the bottom guide 267 and from there it passes between the nip of respective idler roll 290 and feed wheel 290'. The feed wheel 290' contains a one-way clutch 291. The clutch 291 is operated by an arm 292 having a pin 293. Links 294 and 295 are pivotally connected by a pin 296. The link 294 is pivotally connected to the pin 293 and the link 295 is pivotally mounted on a pin 297 mounted to the plate 269. The drive pin 258' contacts the link 295 as the slide 258 moves to the left (FIG. 5) thereby causing the arm 292 to pivot clockwise and rotating the feed wheel 290' clockwise as shown in FIG. 8. A tension spring 298 is connected at one end to the pin 293 and at its other end to the pin 297. When the slide 258 is moved to the right during the next operating cycle of the machine, the drive pin 258' is moved to the right and the spring 298 moves the links 294 and 295 to a position (FIG. 5) in which the adajcent ends of the links 294 and 295 abut an outturned flange 299 of an adjustable slotted stop 300 held in position by screw 301. Adjustment of the stop 300 will adjust the counterclockwise travel of the arm 292 and consequently the angle of rotation of the one-way clutch 291 and the travel of the feed wheel 290.

With reference to FIG. 18, the anvil 128 is shown to include anvil members 307, 308 and 309. The members 307, 308 and 309 can be considered to be anvil members in that they individually absorb some of the force exerted by the plunger 124. The anvil member 308 is generally plate-like but has guide members 310 and 311 which provide a guide groove 312 in which plate-like movable member 129 is received. The anvil member 309 is also plate-like and serves as a retainer for retaining and guiding the movable member 129 for straight line movement and more particularly vertical movement in the groove 312. The anvil member 307 is formed integrally with the plate 269. The anvil member 307, 308 and 309 have respective concave surfaces 313, 314, and 315 which are shown to face downwardly. The curvature of the concave surface 315 is offset from the curvature of surfaces 313 or 314 as best shown in FIGS. 10 through 17. The anvil members 307, 308 and 309 are shown to be held in assembled relationship by screws 316 and 317 which extend through respective holes 318, 319, and 321 and 322 and are threadably received in respective threaded holes 320 and 323. The movable member 129 carries the post or pin 273 which extends through aligned elongated slots 325 and 326 in respective anvil members 307 and 308, and is received by bifurcated end 272 of the actuator 270. The anvil 128 mounts a pivotal brake generally indicated at 327. The brake 327 exerts a braking force against the tag T as it is fed to the pinning zone Z. The brake 327 includes a brake member 328 having a hole 329 at its one end portion 330. The end portion 330 is received in guided relationship in a slot 331 in the anvil member 307. A pivot screw 332 passes through portion 333 of the anvil member 307 and is threaded into threaded hole 334. A compression spring 335 is received in a bore (FIG. 19) in the anvil member 309 and bears against the other end portion 336 of the brake member 328. The force that the spring 335 exerts on the brake member 328 is adjustable by means of a movable abutment 337 carried by an arm 338. A screw 339 received in a threaded bore 340 in the anvil member 309 holds the arm 338 and its abutment 337 in the adjusted position. The brake member 328 is also guided in slot 341 in the anvil member 309.

Figure 46:
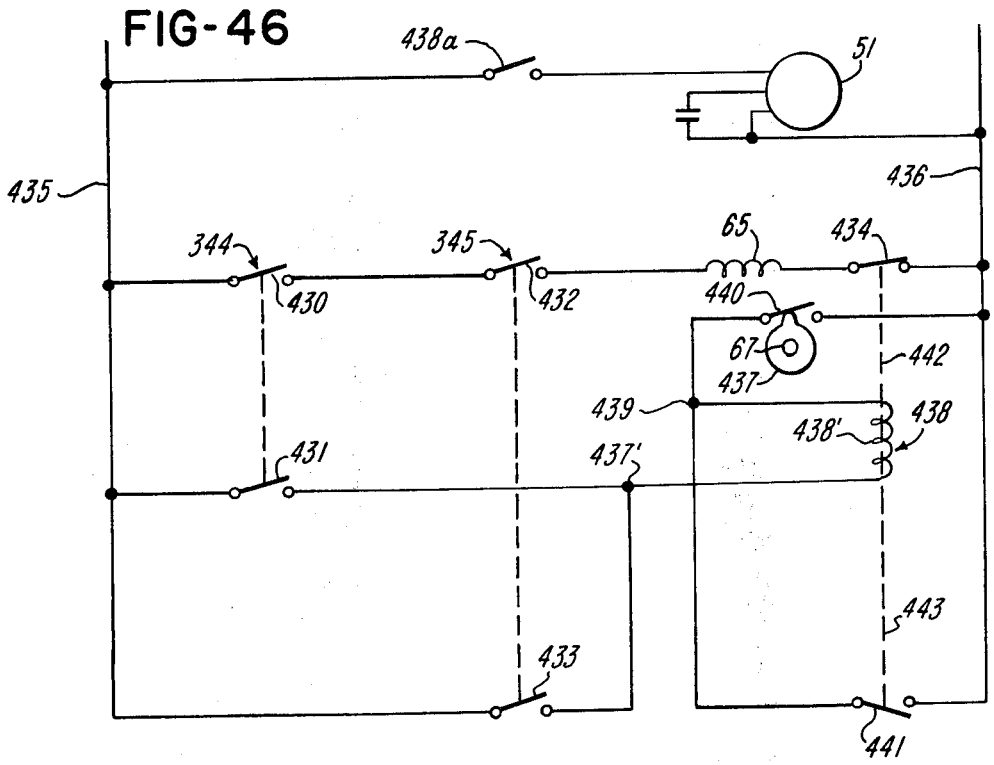
FIG. 46 is a circuit diagram for the apparatus.

With reference to FIG. 20, there are shown two manually operable actuators 342 and 343 also shown in FIGS. 1, 26, 27, 28 and 34 for example for operating respective switches 344 and 345 shown in FIG. 46. In accordance with the invention, the machine 50 can only be operated by manual operation of both actuators and not either one of the actuators 342 or 343 alone. According to FIG. 20, the merchandise M is shown as having been inserted to a position between the plunger 124 and the anvil 128 in which the user's index fingers are shown to be in contact with the actuators 342 and 343. The actuators 342 and 343 are spaced on opposite sides of the plunger 124. The anvil 128 is shown in outline only in FIG. 20. The spacing of the actuator 342 from the plunger 124 and the anvil 128 and the spacing of the actuator 343 from the plunger 124 and the anvil 128 is such that the hands of the user are free from the pinning zone Z where the tag T is clamped between the plunger 124 and the anvil 128 and where the pin P is driven through the tag T and the merchandise M. In that two-hand manual actuation is required to initiate a cycle of machine operation, both hands of the user must be free of the pinning zone, and yet the merchandise can be grasped at spaced-apart locations as shown in FIG. 20, so that the plunger 124 and the anvil 128 can cooperate with the tag T and the merchandise M. The circuit diagram shown in FIG. 46 will be explained in connection with the overall operation of the machine.

Figure 37:
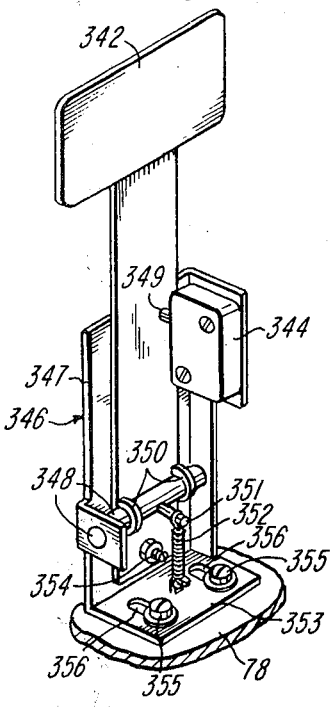
FIG. 37 is a perspective view of one of the actuators used to initiate a machine cycle.

The actuators 342 and 343 and their associated mounting means are identical and accordingly only one actuator 342 and its associated mounting means and switch is shown in FIG. 37. The mounting assembly generally indicated at 346 is shown to include a bracket 347 for mounting a pin 348. The pin 348 pivotally mounts the actuator 342. The bracket 347 also mounts the switch 344 which has an actuating spring-urged plunger 349. Straps 350 secured to the actuator 342 and to the pin 348 enable the actuator 342 and the pin 348 to pivot as a unit. A post 351 secured to the pin 348 anchors one end of a tension spring 352. The other end of the spring 352 is anchored to a flange 353 of the bracket 347 and normally urges the actuator 342 clockwise as viewed in FIG. 37, thereby depressing the plunger 349. Manual actuation of the actuator 342 causes the actuator 342 to pivot counterclockwise, thereby causing the plunger 349 to move outwardly to close the switch 344. Release of the actuator 342 will enable the spring 352 to pivot the actuator 342 clockwise, thereby depressing the plunger 349 and opening the switch 344. The position of the actuator 342 can be adjusted by means of set screw 354, the free end of which abuts the bracket 347 due to the action of the spring 352 when the actuator 342 is released. Accordingly, the amount of movement of the actuator 342 can be adjusted by adjusting the set screw 354. The position of the mounting assembly 346 and the actuator 342 can be adjusted toward and away from the front of the machine 50 by means of screws 355 passing through slots 356 in the flange 353 and threadably received in the base plate 78.

With reference to FIG. 19, plates 357 and 359 are secured to the plate 358 by threaded fasteners 360. A bracket 361 spaced from the plate 358 is connected to the plates 357 and 359 by fasteners 362. A plate 363 is secured yo yhr yop og yhr plsyr 358 by fasteners 364. The plate 358 has holes 365 for receiving generally hat-shaped members 366 which are retained by flanges 366'. The plates 357, 358, 359, and 363, the bracket 361, and the members 366 are considered to be part of the body or frame 205. A slide 367 is slidably mounted on a post or guide 368 threadably received in the plate 358. Springs 369 and 370 are equidistantly spaced on opposite sides of the post 368 so that the slide 367 is normally urged toward the right as shown in FIG. 39, for example, that is, toward the pinning zone Z between the plunger 124 and the anvil 128 at the front of the machine. The slide 367 is capable of being moved in the opposite direction, that is, away from the pinning zone Z by the action of a cam-controlled lever 371 in the form of a bell crank. The lever 371 has arms 372, 372', and 373 secured to a shaft 374. The outer ends of arms 372, 372', and 373 rotatably mount respective rollers 375, 375' and 376 which are equidistantly spaced from the guide 368. Referring to FIG. 23, for example, the cam 76 drives a roller follower 377 carried by a bell crank generally indicated at 378. The bell crank 378 is pivotally mounted on the shaft 108. The bell crank 378 carries a roller 381 which drives a slide 382. The slide 382 is guided for vertical movement by pins 383 received in slots 384 in the slide 82. Retainers 385 prevent horizontal movement of slide 382. The slide 382 is movable from the lowered or solid line position shown in FIG. 23 to the raised or phantom-line position shown in FIG. 23. As the slide 382 moves from the home or fully lowered position shown in FIG. 41, to the position shown in FIG. 42, bell crank 371 pivots counterclockwise driving the slide 367 to the left. Lowering of the slide 382 as shown in FIG. 44 enables springs 369 and 370 to drive the slide 367 to the right. Roller 376 can ride on the horizontal upper surface of the slide 382 and cause movement of needles 411, 412 and 413 in any selected position of the device 182 relative to the pinning zone Z.

The slide 367 comprises a plate 386 to which plates 387 and 388 are connected by fasteners 390. The plates 387 and 388 have horizontally elongated guide slots 387*a* and 388*a* in which respective guide pins 387*b* and 388*b*, mounted by plates 357 and 359, are received. The plate 386 has three slots 391, 392, 393. A pin or shaft 395 extends through a bore in the plate 386 and all of the slots 391, 392 and 393. Therefore, identical latches 396, 397 and 398 disposed in respective slots 391, 392 and 393 are pivotally mounted on the shaft 395. A pin or shaft 395' is mounted at its end portions in plates 387 and 388. Independently movable needle mounting members 396', 397' and 398' are pivotally mounted on the shaft 395'. Spacers 401 and 402 are disposed on opposite sides of the member 396'. The spacer 402 and a spacer 403 are disposed on opposite sides of the member 397'. The spacer 403 and a spacer 404 are disposed on opposite sides of the member 398'. The mounting members 396', 397' and 398' are identical so that only one, namely the mounting member 396', is shown in detail in FIG. 45. The respective needle mounting members 396', 397', and 398' are urged counterclockwise by respective spiral springs 405', 406' and 407' as viewed in FIG. 41, for example. In that the latches 396, 397 and 398 operate substantially in unison, the operation of these latches and their respective needle mounting members 396', 397' and 398' will be described with reference only to latch 396 and its respective needle mounting member 396'. In FIG. 41, for example, the needle mounting member 396' is latched in its clockwise position by the latch 396. In particular, latching is accomplished by a shoulder 396*a* of the latch 396 bearing against a pin 396*b* carried by the member 396'.

As the slide 367 moves to the left as viewed in FIG. 42, the latches 396, 397 and 398 eventually contact abutments or stop screws 396*c*, 397*c* and 398*c*.

In the position shown in FIG. 42, the needle mounting members 396', 397' and 398' are still latched by respective latches 396, 397 and 398. As the slide 367 continues to move toward the left to the position shown in FIG. 43, the stop screws 396*c*, 397*c*, and 398*c* cause the latches 396, 397 and 398 to pivot counterclockwise in the direction of arrow A2. The needle mounting members 396', 397' and 398' are prevented from rotating counterclockwise because their respective abutment portions 405, 406 and 407 contact respective stop screws or abutments 408, 409, and 410. Depending upon the relative adjustments of screws 396*c*, 397*c* and 398*c* and related stop screws 408, 409 and 410, the abutment portions 405, 406 and 407 may contact stop screws 408, 409 and 410 before the slide 367 has moved to the end of its travel to the left to its fully retracted position. In this event, the needle mounting members 396', 397', and 398' will actually pivot clockwise. On the other hand, if the latches 396, 397 and 398 are tripped before abutment portions 405, 406 and 407 contact stop screws 408, 409 and 410, then tripping of the latches 396, 397 and 398 will cause the needle mounting members 396', 397' and 398' to pivot counterclockwise until their respective abutment portions 405, 406 and 407 contact respective stop screws 408, 409 and 410. In any event, needles 411, 412 and 413 mounted respective members 396', 397' and 398' remain below the bottom tag T in the stack S. As the slide 382 is lowered, the follower 371 pivots clockwise and the springs 369 and 370 drive the slide 367 to the right. As the slide 367 moves to the right, the needle mounting members 396', 397' and 398' pivot counter clockwise until pins 396*b*, 397*b* and 398*b* contact respective abutment faces 396*d*, 397*d*, and 398*d* during pivotal movement of the needle mounting members 396', 397' and 398' from the position shown in FIG. 43 to the position shown in FIG. 44. The abutment faces 396*d*, 397*d* and 398*d* latch the respective needle mounting member 396', 397' and 398' in respective positions so that penetration of the needles 411, 412, and 413 is limited. The needles 411, 412, and 413, thus, pivot into impaling engagement with the bottom tag T. The needles 411, 412 and 413 penetrate or pierce the bottom tag without passing through the bottom tag T. As the slide 367 continues to move to the right, the bottom tag T passes through the gate mechanism 227 to the phantom line position shown in FIG. 44. At the end of travel of the slide 367, namely its fully extended position shown in FIG. 44, stop screws or abutments 414, 415, and 416 abut the needle mounting members 396', 397' and 398' to cause their pivotal movement in a clockwise direction about shaft 395' so that the latches 396, 397 and 398 can be pivoted clockwise by respective springs 396*e*, 397*e*, and 398*e* as shown in FIG. 40. FIG. 40 shows the components in the home position as in FIGS. 38, 39 and 41. It is noted in FIG. 40 that the rod 155 passes through a hole 418 in the plate 358 with adequate clearance so that no part of the tag feeding assembly 182 contacts a rod 155.

With reference to FIG. 45, the needle mounting member 396' is shown as having an elongated through-slot 419. The needle 411 is received in the slot 419 and a flexible resilient plate 420 contacts the needle 411 and frictionally and removably holds the needle 411 in the slot 419. The plate 420 has a tab 421 against which blunt end 422 of the needle 411 is seated. Two screws 423 passing through respective holes 424 in the plate 420 are received in threaded holes 425 in the member 396'. An end portion 426 of the plate 420 adjacent the slot 419 is bent outwardly. A worn needle 411 can be readily removed as by grasping the exposed end portion with pliers and pulling the needle 411 out of the groove 419. A new needle having a sharp end can be inserted into the groove 419 using pliers which can be used to push the needle into the groove until end 422 is seated against the tap 421. The other mounting members 397' and 398' and associated latch components are identical to those shown in FIG. 45.

Referring now to FIG. 46, the switches 344 and 345 include mechanically connected switches 430 and 431 and 432 and 433, respectively. When the switch 344 is closed, the switches 430 and 431 are closed, and vice versa. When the switch 345 is closed, the switches 432 and 433 are closed, and vice versa. The clutch solenoid 65 is connected to a normally closed switch 434. The switch 430 is connected to a lead 435 and the switch 434 is connected to a lead 436. The switches 430 and 432, the clutch solenoid 65, and the switch 434 are connected in series. The switches 431 and 433 are connected to the lead 435 and to a node 437'. A coil 438' of a relay 438 is connected to the node 437' and to a node 439. A normally closed switch 440 and a normally open switch 441 in parallel with each other are connected to a node 439 and to the lead 436. The switch 440 is controlled by a cam 437 secured to the cam shaft 67. When the cam shaft 67 is in the home position the cam 437 holds the switch 440 open. The electric motor 51 is connected to the leads 435 and 436 through a switch 438*a*. The motor 51 operates whenever the switch 438*a* is closed. When one of the switches 344 or 345 is closed and the other one is open, neither the clutch coil nor the relay coil 438' can be energized. It is apparent that manual actuation of the actuator 342 or the actuator 343 without actuation of the other is ineffective. It is only when the switches 344 and 345 are simultaneously in the closed position, that the clutch coil 65 is energized through the switches 430 and 432 and the normally closed switch 434. Energization of the clutch coil 65 will cause the clutch 64 to be engaged, thereby causing the cam shaft 67 to rotate. Rotation of the cam shaft 67 will cause the cam 437 to rotate, thereby closing the switch 440. When the switch 440 is closed and assuming that at least one of the switch elements 431 and 433 is still in the closed condition, the relay 438 will be energized, thereby opening the switch 434 and closing the switch 441. The switches 434 and 441 are part of the relay 438 and are mechanically coupled to the relay coil 438' as indicated by respective broken lines 442 and 443. Opening of the switch 434 causes the clutch solenoid to be deenergized thereby causing disengagement of the clutch at the end of one complete rotation of the cam shaft 67. Energization of the relay coil 438' so long as at least one of the switches 431 or 433 is closed, prevents the switch 434 from closing and consequently prevents energization of the clutch solenoid 65. If both of the actuators 342 and 343 are released, then both the switches 344 and 345 will be open and consequently the switches 431 and 433 fail to complete a circuit through the relay coil 438', thereby causing the switch 434 to close and the switch 441 to open. Accordingly, the clutch can only be operated again by actuating both actuators 342 and 343 so that the switches 344 and 345 are simultaneously in the closed condition. It is apparent that the switch 344 can be closed before the switch 345 is closed, or vice versa, but it is only when both the switches 344 and 345 are in the closed condition that the clutch solenoid 65 is operated and the clutch solenoid 65 cannot again be operated until after both the switches 344 and 345 are released.

Figure 47:
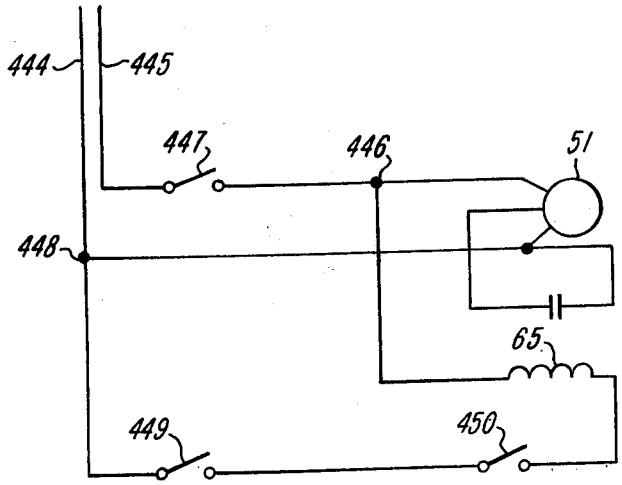
FIG. 47 is a circuit diagram showing an alternative embodiment.

With reference to an alternative embodiment shown in FIG. 47, there are shown leads 444 and 445. The lead 445 is connected to a node 446 through a switch 447. The electric motor 51 is connected to the node 446 and to a node 448 which is connected to the lead 444. Switches 449 and 450 and the clutch solenoid 65 are connected in series with each other and in turn to respective nodes 446 and 448. The switches 449 and 450 are positioned to be acutated by actuators 342 and 343 and are disposed in the same positions relative to the actuators 342 and 343 as are the switches 344 and 345 in the other embodiment. The switches 449, 450 and 447 are required to be in the closed condition before the clutch solenoid 65 can be operated. During operation of the machine, the switch 447 is closed to operate the motor 51 and consequently actuation of the actuators 342 and 343 such that the switches 449 and 450 are both in the closed condition at the same time will cause energization of the clutch coil 65'.

Figure 48:
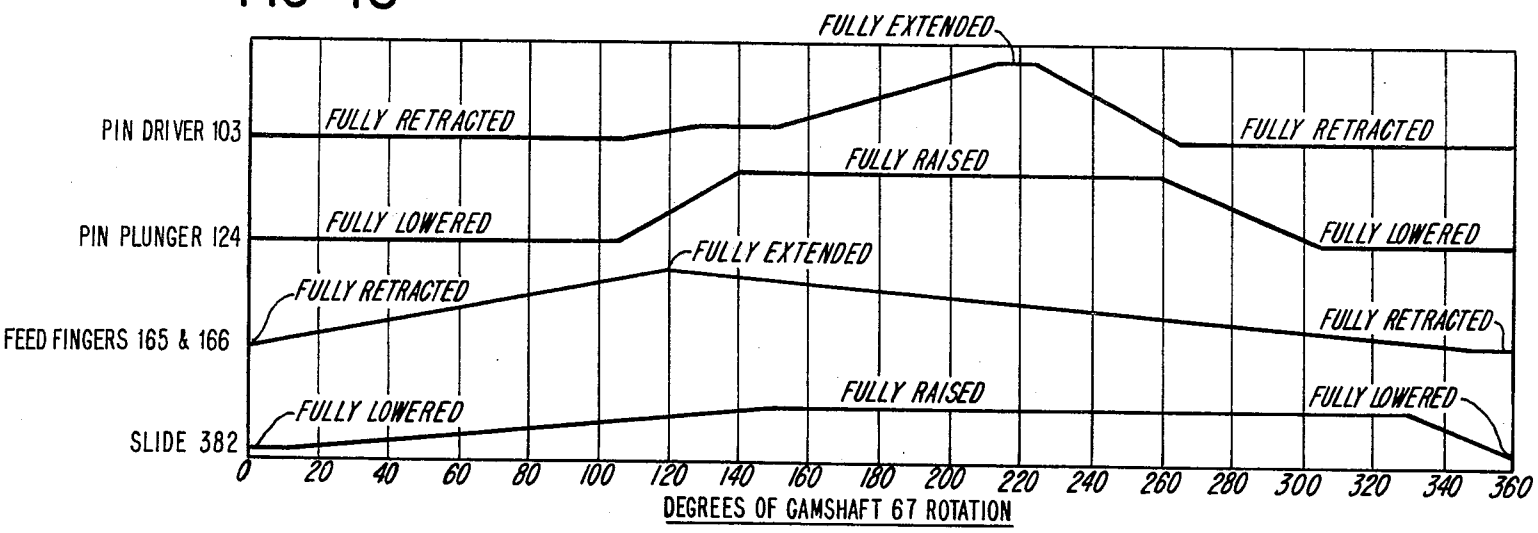
FIG. 48 is a timing diagram for the pinning machine.

With reference to FIG. 48, there is shown a timing diagram showing the movement of the pin driver 103, the plunger 124, the feed fingers 165 and 166 and the feed assembly slide 382, with respect to degrees of cam shaft rotation. It is apparent that the device 182 which separates the tag T from the stack S moves through an operational sequence which overlaps the operational sequence of the tag feeding device 181 which advances the tag T to the pinning zone. It is to be noted that the movement of the feed is completed relatively early in the machine cycle to position a tag T at the pinning zone Z which was separated from the stock S by the device 181 in the previous machine cycle. It is apparent that in each machine cycle, a tag T is positioned at the pinning zone Z and later in the same cycle a tag T is separated from the stack S.

Other embodiments and modifications of this invention will suggest themselves to those skilled in the art, and all such of these as come within the spirit of this invention are included within its scope as best defined by the appended claims.

I claim:

1. Apparatus for pinning tags to merchandise and including means for feeding a tag into position to be pinned onto merchandise, means for holding a tag and merchandise together in bent orientation, means for driving a pin through the tag and merchandise to pin the tag and the merchandise together, and means for moving the tag feeding means, the improvement residing in the moving means which includes a drive pin, means for driving the drive pin in a circular path, and a follower having an elongated slot in which the drive pin is received.

2. Apparatus as defined in claim 1, wherein the follower comprises a pair of follower members positioned to provide an elongated slot, means for pivotally mounting the follower members on a common pivot, spring means for holding the follower members together but enabling relative pivotal movement between the follower members to open up the slot in the event excess force is exerted against the follower by the feeding means.

3. Apparatus as defined in claim 1 the follower including follower sections, and spring means coupled to the follower sections for enabling the follower sections to move relative to each other to prevent damage to the follower or the pin in the event excess force is exerted against the follower by the feeding means.

4. Apparatus as defined in claim 1, wherein the moving means further includes a link connecting the follower and the tag feeding means, and a pivot for pivotally mounting the follower, the link being connected to the follower at a greater distance from the pivot than the portion of the elongated slot with which the drive pin cooperates.

5. Apparatus for attaching tags to merchandise, comprising: means for inserting a fastener into merchandise at a tag attaching zone to attach tag to the merchandise during an operating cycle and means for feeding a tag to the tag attaching zone during the cycle including a drive pin, means for driving the drive pin in a circular path, a follower having an elongated slot in which the drive pin is received, and manually operable means for initiating a cycle.

6. Apparatus as defined in claim 5, wherein the follower comprises a pair of follower members positioned to provide an elongated slot, means for pivotally mounting the follower members on a common pivot, spring means for holding the follower members together but enabling the relatively pivotal movement between the follower members to open up the slot in the event excess force is exerted against the follower by the feeding means.

7. Apparatus as defined in claim 5, including means related to the follower for preventing damage to the follower or the pin in the event excess force is exerted against the follower by the feeding means.

8. Apparatus as defined in claim 5, wherein the moving means further includes a link connecting the follower and the tag feeding means, and a pivot for pivotally mounting the follower, the link being connected to the follower at a greater distance from the pivot than the portion of the elongated slot with which the drive pin cooperates.

9. Apparatus for pinning tags to merchandise, comprising: an anvil, a generally vertically movable plunger cooperable with the anvil for holding a tag and merchandise in a bent orientation, means for feeding a tag to a pinning position between the plunger and the anvil, a generally horizontal cam shaft, a pair of plate cams secured to the cam shaft, a generally vertical shaft, a pair of followers mounted on opposite sides of the vertical shaft and cooperable with the respective plate cams so that rotation of the cam shaft causes the vertical shaft to oscillate about a generally vertical axis, means coupled to the vertical shaft for driving a pin through the tag and the merchandise while the plunger and the anvil are in cooperation, a pin driven in a circular path by the cam shaft, and a follower having a slot in which the pin is received for driving the feeding means upon rotation of the cam shaft.

10. Apparatus for pinning tags to merchandise and including a frame, an anvil mounted to the frame, a plunger cooperable with the plunger for holding a tag and merchandise together in a bent orientation, means for feeding a tag to a pinning position between the plunger and the anvil, means for driving a pin through the tag and the merchandise while the plunger and the anvil are cooperating, means for moving the tag feeding means, the plunger and the pin driving means including a generally horizontal cam shaft, a connection between the cam shaft and the plunger including resilient means for preventing movement of the plunger toward the anvil upon encountering excessive resistance, and a connection between the cam shaft and the pin driving means including resilient means for preventing movement of the pin driving means toward the pinning position upon the pin driving means encountering excessive resistance, the improvement comprised in the connection between the cam shaft and the pin driving means and including a generally vertical shaft, a pair of followers mounted on opposite sides of the shaft, a pair of cams secured to the cam shaft and cooperable with the pair of followers, and vertically spaced bearings for mounting the generally vertical shaft for rotation about a generally vertical axis.

11. Apparatus as defined in claim 10, wherein the frame has a generally horizontal base plate and a generally horizontal frame plate disposed above the base plate, wherein one of the bearings is mounted by the base plate and another of the bearings is mounted to the frame plate.

12. Apparatus as defined in claim 10, wherein the connection between the cam shaft and the pin driving means includes a movable arm connected to the generally vertical shaft between the bearings.

13. Apparatus for pinning tags to merchandise and including a frame, an anvil mounted to the frame, a plunger cooperable with the anvil for holding a tag and merchandise together in a bent orientation, means for feeding a tag to a pinning position between the plunger and the anvil, means for driving a pin through the tag and merchandise while the plunger and the anvil are cooperating, and means for moving the tag feeding means, the plunger and the pin driving means in sequence, the moving means including a generally horizontal cam shaft having cam means, the improvement comprising that the moving means includes a generally vertical shaft driven in opposite directions about a generally vertical axis by the cam means, means including an arm driven by the generally vertical shaft for moving the pin driving means, and means including a slide driven by the cam means for moving the tag feeding means.

14. Apparatus as defined in claim 13, including means for guiding the slide for generally vertical straight line movement.

* * * * *